US005561905A

United States Patent [19]

Sherman

[11] Patent Number: 5,561,905

[45] Date of Patent: Oct. 8, 1996

[54] LETTER OPENER

[76] Inventor: Alan E. Sherman, 12215 Dorsett Rd., St. Louis, Mo. 63043

[21] Appl. No.: 319,076

[22] Filed: Oct. 6, 1994

Related U.S. Application Data

[63] Continuation-in-part of Ser. No. 27,228, Aug. 16, 1994, abandoned.

[51] Int. Cl.[6] ..... B26B 29/00

[52] U.S. Cl. ..... 30/280; 30/294

[58] Field of Search ..... 30/2, DIG. 3, 278, 30/279.2, 280, 286, 287, 289, 294, 296.1; D8/102; 83/578

[56] References Cited

U.S. PATENT DOCUMENTS

| | | | |
|---|---|---|---|
| D. 306,394 | 3/1990 | Koenig | D8/102 |
| D. 329,584 | 9/1992 | Shevin et al. | D8/102 |
| D. 329,798 | 9/1992 | Kramer et al. | D8/102 |
| 1,553,449 | 9/1925 | Kennedy | 30/294 |
| 2,274,978 | 3/1942 | Currier | 83/578 |
| 2,456,436 | 12/1948 | Metzger | 30/DIG. 3 |
| 2,610,399 | 9/1952 | Adams et al. | 30/294 |
| 3,071,034 | 1/1963 | Castelli | 83/578 |
| 3,383,768 | 5/1968 | Hamilton | 30/294 |
| 5,003,856 | 4/1991 | Fujimura et al. | 83/578 |
| 5,285,577 | 2/1994 | Carney et al. | 30/294 |

FOREIGN PATENT DOCUMENTS

| | | | |
|---|---|---|---|
| 50557 | 8/1965 | German Dem. Rep. | 83/578 |

OTHER PUBLICATIONS

Quick Point catalog, 1990, pp. 52 and 53, "Envelope Opener".

*Primary Examiner*—Hwei-Siu Payer

*Attorney, Agent, or Firm*—Polster, Lieder, Woodruff & Lucchesi

[57] ABSTRACT

A letter opener includes a handle portion, a depending neck portion, and oppositely extending tine portions carried by the neck portion. A cutting edge is mounted on each side of the neck portion such that either of the tine portions can be inserted under the flap of a sealed envelope and moved across the envelope to permit the respective cutting edge to slice open the envelope. Since the novel letter opener according to the invention includes two cutting edges, the useful life of the letter opener is doubled over the useful life of prior art, single cutting edge letter openers. Inasmuch as the letter opener may carry one or more informational messages, such as advertising messages, postal rate information, etc., the length of time the messages are exposed to the user is also doubled, thereby doubling the value of the letter opener to both the user as well as those employing the letter opener as a medium of communication to the user.

11 Claims, 2 Drawing Sheets

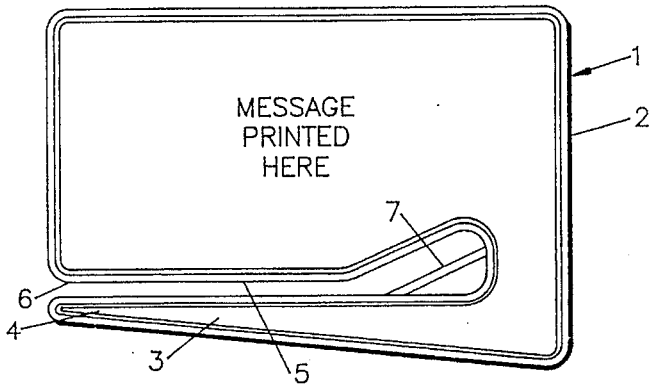
FIG.1 (PRIOR ART)
FIG.2
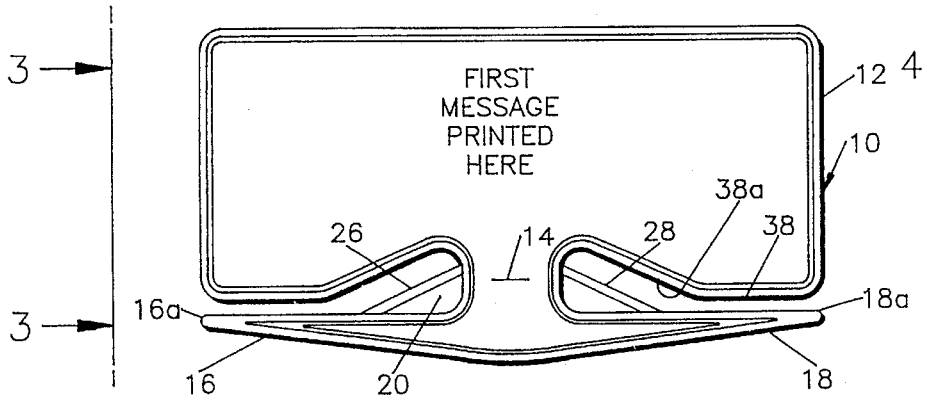
FIG.3
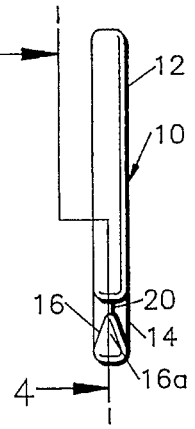
FIG.4
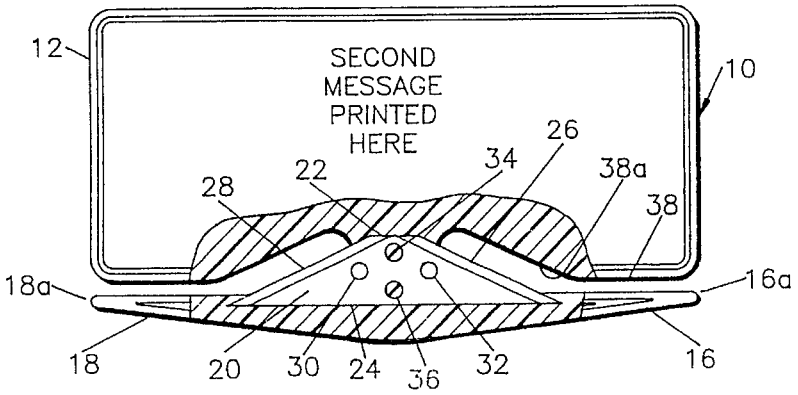

FIG.5
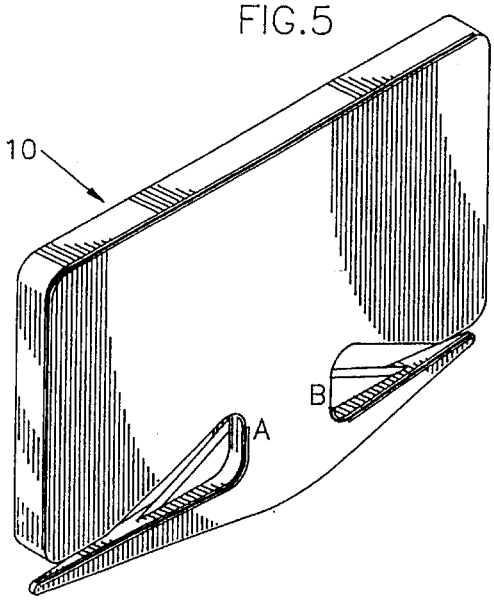
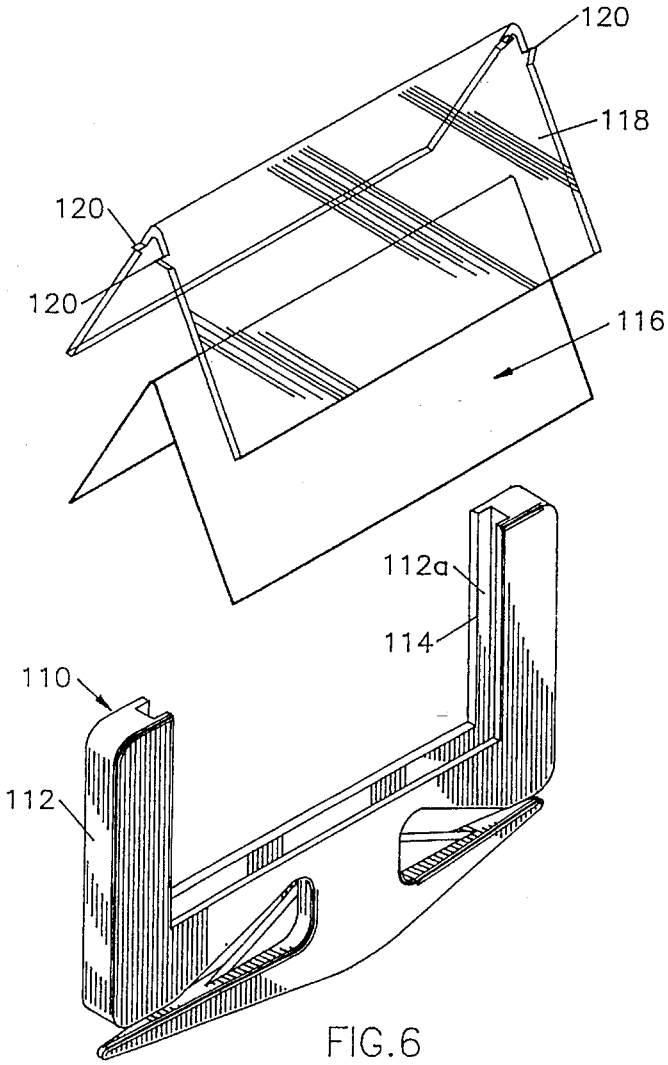
FIG.6

LETTER OPENER

CONTINUING APPLICATION DATA

This is a continuation-in-part of my design patent application, Ser. No. 29/027,228, filed Aug. 16, 1994, now abandoned.

BACKGROUND OF THE INVENTION

The present invention relates to letter openers having a cutting edge which may be used to slice open the upper flap edge of an envelope. More particularly, the invention is an improvement upon the type of letter openers sometimes known in the trade as ZIPPY letter openers.

These prior art letter openers include a single tapered tine extending from a handle portion creating a gap between the handle portion and tine. Within the gap, a cutting edge, usually of metal, is directed toward the free end of the tine. In operation, the tine is inserted under the sealed flap of the envelope and pushed along the flap edge as the cutting edge slices the flap from the body of the envelope thus neatly exposing the contents of the envelope.

A primary use of the prior art type of letter opener is to carry an advertising message, a company logo, or other custom printing, either imprinted directly upon or carried by the generally flat handle portion. Since the cutting edge is subject, through repeated use, to becoming dull and ultimately unusable, the letter opener will be discarded along with the printed message. Therefore one value of the letter opener is directly related to the length of time it remains sharp and usable.

SUMMARY OF THE INVENTION

The letter opener according to the present invention includes a handle portion capable of being directly imprinted with, or carrying thereon, an advertising or other informational message. A neck portion depends from the handle portion and carries two oppositely directed tines in the general plane of the handle. Within the two gaps created between the handle portion and the two tines there is positioned a pair of oppositely directed cutting edges, each directed toward the free end of a respective tine. When held in the right hand, for example, one side of the handle and its message is exposed to the user as the letter opener is utilized to slice open an envelope. When the letter opener is flipped over, again for a right-handed user, the message on the other side of the handle is then exposed to the view of the user and the second cutting edge may be used. Assuming the cutting edge life of each of the two cutting edges is the same as the prior art, single-edged letter opener, not only is the communication life of the novel letter opener doubled, but also the number of promotional messages is doubled. For about the same cost of manufacturing, the letter opener according to the invention has double the effectiveness and value as an advertising or international communication medium.

It is therefore the main object of the invention to provide a letter opener capable of producing a useful life double that of prior art letter openers and twice the promotional value.

It is a more specific object to provide a letter opener having a handle portion, a depending neck portion, and a pair of oppositely extending tines, at least in part integrally molded with the neck and handle portions with two oppositely directed cutting edges between respective tine portions and the body portion to provide a letter opener having twice the useful life of previous letter openers with similar cost of manufacture.

It is a still further object to provide a letter opener capable of exposing an advertising message on both sides of the handle to the user when used by a right-handed or left-handed user.

Other objects and advantages will become more apparent from the following description of the preferred embodiments in conjunction with the drawings wherein:

FIG. 1 is a front elevational view of a prior art single cutting edge letter opener;

FIG. 2 is a front elevational view of a letter opener constructed in accordance with the principles of the present invention;

FIG. 3 is a side elevational view of the letter opener taken along line 3—3 or FIG. 2;

FIG. 4 is a back view of the letter opener partially in section showing the preferred blade construction and taken along line 4—4 of FIG. 3;

FIG. 5 is an isometric view of a letter opener according to the principles of the invention having a handle portion adapted to be directly printed thereon; and FIG. 6 is an exploded perspective view of an alternative embodiment having a separate communication medium adapted to be held under a folding two-sided lens on the main body of the letter opener.

DETAILED DESCRIPTION OF THE PREFERRED EMBODIMENTS

With reference to the drawings, and FIGS. 2–6 in particular, these are shown the preferred embodiments of a letter opener embodying the advantages and constructed in accordance with the principles and objects of the present invention.

FIG. 1 shows one typical embodiment of a prior art letter opener generally referred to by the numeral 1. The known letter opener 1 includes a generally planar, plastic, body or handle portion 2 with a depending integrally molded plastic tine portion 3 extending generally in the same plane with body portion 2 and having a tapered free end portion 4. Tine portion 3 is positioned beneath body portion 2 to create a gap 5 therebetween having open end 6. A single cutting edge 7, usually of metal, faces in an inclined manner toward open end 6 of gap 5. A printed message is either printed directly upon body portion 2 or carried thereby. The front side of body portion 2 shown in FIG. 1 is usually the only side carrying a message since a right-handed user will pick up and hold prior art letter opener 1 with only the front side of body portion 2 in view. Further the user will discard the letter opener when cutting edge 7 becomes dull and no longer cuts open an envelope cleanly.

FIGS. 2–4 show one preferred embodiment of the novel letter opener 10 constructed according to the principles of the present invention. Opener 10 includes a main body portion or handle 12 of molded plastic, an integral neck portion 14 and integral first and second oppositely directed tine portions 16, 18, respectively, extending from neck portion 14. Tine portions 16 and 18 each taper from the neck portion 14 toward the free ends thereof 16*a*, 18*a*, respectively, in order to make it easier for the tine portions to be inserted beneath the flap of a sealed envelope (not shown).

Tines 16 and 18, along with neck 14 are integrally injection molded of plastic material in generally the same plane with body 12. Molded within neck portion 14 and tines 16. 18 is preferably a single metal blade 20 of a generally trapezoidal shape having top and bottom parallel sides 22, 24, respectively, and first and second, generally inclined sides which have been sharpened to create first and second cutting edges 26, 28, respectively. As shown in FIG. 4, metal blade 20 includes holes 30, 32 which aid in holding blade 20 in place during the molding process and additional holes 34, 36 through which molten plastic flows during the molding process to further strengthen opener 10 and particularly neck portion 14. It is noted that body portion 10 includes a bottom edge 38 which is spaced from tines 16 and 18 and cutting edges 26 and 28 to produce a small gap first between the tines and bottom edge 38 and then an inclined portion 38*a* which produces a small gap between cutting edges 26, 28 and bottom edge 38 of body portion 12. In this manner, bottom edge 38 helps protect the user from being inadvertently cut by blade 20.

It is specifically noted that single blade 20 with cutting edges 26, 28 could be replaced if desired with two separate blades, each with a single cutting edge. While this alternative method would probably produce a slightly cheaper sharpening process, the cost for two discreet blades and their additional handling would be considerably more expensive than one blade with two edges, and overall integrity of the opener would be slightly weakened, and the possibility of a misaligned blade during the molding process would be doubled, creating a greater chance of damaging the mold during the manufacturing process.

It can readily be seen that either of tines 16 or 18 can be inserted beneath the flap of a sealed envelope, and as opener 10 is pushed across the edge of the envelope a respective cutting edge 26 or 28 will act to cleanly slice open the envelope while tine 16 or 18 holds the respective cutting edge in proper relation to the envelope edge. It can also be seen that since a right-handed user, for example, will be able to use opener 10 holding either side up, the user will either see a first message on a front side or a second message on a back side as indicated in FIGS. 2 and 4. Further, these messages will remain with the user as long as either cutting edge 26 or 28 is still usably sharp.

FIG. 5 shows letter opener 10 which may be directly imprinted with a message on both sides thereof and shows cutting edge indicia such as A and B marked on both sides of the opener to identify to the user which cutting edge is being utilized. This way the user has better control over the use of the opener, and can use one cutting edge until it wears out and then switch to the other. Alternatively, the user could use one cutting edge for normal envelopes and the other cutting edge for harder to cut and more blade-damaging, taped packages, etc.

FIG. 6 shows an alternative method for opener 110 to carry advertising or other messages on body portion 112. According to this embodiment, body portion 112 includes a U-shaped plastic holder 112*a* having an internal slot 114 into which can be slid a folded printed medium 116 covered by a clear folded plastic lens 118. Detents 120 are provided on lens 118 to clip into slot 114 in order to hold printed medium 116 securely in place. One advantage of this embodiment shown in FIG. 6 is that both sides of opener 110 can be printed with a message for approximately the same cost as printing a single sided message, since only one side of medium 16 is printed before it is folded and put in place under the folding, two-sided lens. Another advantage of this embodiment is that both sides of the message are protected from dirt, handling and abrasion by a single, folded plastic lens. It is also recognized that the lens may be affixed to the body by other means such as ultrasonically welding the lens to the body.

While it is apparent that the above-described preferred embodiments fulfill the objects and obtain the advantages of the invention as set forth hereinabove, it is to be understood that numerous modifications could be made to the preferred embodiments without departing from the spirit and scope of the invention, which is solely defined by the following claims.

I claim:

1. A letter opener comprising:

a main body portion adapted to be utilized as a handle:

a neck portion depending from said main body portion;

first and second tine portions extending from said neck portion, each of said tine portions having a free end portion on the opposite end thereof from said neck portion, and said free end portions of said tine portions being formed such that either of said free end portions of said tine portions can be inserted under the flap of a sealed envelope: and a first cutting edge held adjacent said first tine portion with said first cutting edge being generally directed toward the free end portion of said first tine portion; and a second cutting edge held adjacent said second tine portion with said second cutting edge being generally directed toward the free end portion of said second tine portion;

whereas either of said first and second tine portions can be inserted under the flap of a sealed envelope and moved across the envelope to permit a respective cutting edge to slice open the envelope.

2. The letter opener as specified in claim 1 wherein:

said main body portion, said neck portion, and said tine portions are fabricated at least in part of integrally molded plastic material and said cutting edges are fabricated of metal.

3. The letter opener as specified in claim 2 wherein:

said cutting edges include an unexposed portion molded into said neck and tine portions and said unexposed portions having holes therein through which plastic may flow during the manufacturing process to help strengthen the integrity of the letter opener and to help hold said cutting edges in place after the molding process.

4. The letter opener as specified in claim 1 wherein:

said cutting edges are formed on a single blade held within said tine and neck portions.

5. The letter opener as specified in claim 4 wherein:

said single blade is generally in the shape of a trapezoid with the cutting edges being formed on the non-parallel, inclined sides.

6. The letter opener as specified in claim 1 wherein:

said tine portions extend in opposite directions.

7. The letter opener as specified in claim 6 wherein:

said main body portion, said neck portion and said tine portions generally extend within a single plane.

8. The letter opener as specified in claim 7 wherein:

said main body portion carries an informational message on each planar side thereof.

9. The letter opener as specified in claim 1 wherein:

an informational message is carried on at least one side of said main body portion.

10. The letter opener as specified in claim 1 wherein:

said letter opener includes indicia on each planar side thereof to indicate to the user which of the two cutting edges is being utilized to ensure maximum usage of each of said cutting edges.

11. The letter opener as specified in claim 1 wherein:

said letter opener further comprising a folded printed medium, a single clear folded plastic lens covering said folded printed medium for protecting both sides of the medium from abrasion, handling and soiling, and said plastic lens and printed medium being secured to the main body portion.

* * * * *